US011898569B2

(12) United States Patent
Liedel et al.

(10) Patent No.: US 11,898,569 B2
(45) Date of Patent: Feb. 13, 2024

(54) BANDED COOLING FAN BAND HAVING KNIT-LINE STRENGTH IMPROVEMENT

(71) Applicant: Robert Bosch GmbH, Stuttgart (DE)

(72) Inventors: Markus Liedel, Buehl (DE); Alain-Bernard Isel, Riedseltz (FR); Ray Cote, Dover, MA (US); Eugen Stockmann, Karlsruhe (DE); Serge Nako, Souffelweyersheim (FR)

(73) Assignees: Robert Bosch LLC, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/915,699

(22) PCT Filed: Apr. 6, 2021

(86) PCT No.: PCT/EP2021/058879
§ 371 (c)(1),
(2) Date: Sep. 29, 2022

(87) PCT Pub. No.: WO2021/204766
PCT Pub. Date: Oct. 14, 2021

(65) Prior Publication Data

US 2023/0132288 A1 Apr. 27, 2023

Related U.S. Application Data

(60) Provisional application No. 63/147,500, filed on Feb. 9, 2021, provisional application No. 63/006,840, filed on Apr. 8, 2020.

(51) Int. Cl.

| | |
|---|---|
| ***F04D 29/02*** | (2006.01) |
| ***F04D 29/32*** | (2006.01) |
| ***F04D 29/38*** | (2006.01) |

(52) U.S. Cl.
CPC ..... *F04D 29/023* (2013.01); *F04D 29/32* (2013.01); *F04D 29/326* (2013.01); *F04D 29/388* (2013.01)

(58) Field of Classification Search
CPC ..... F04D 29/326
See application file for complete search history.

(56) References Cited

U.S. PATENT DOCUMENTS

| | | | |
|---|---|---|---|
| 5,810,555 A | 9/1998 | Savage et al. | |
| 10,563,664 B2 * | 2/2020 | Springer | F04D 29/326 |

FOREIGN PATENT DOCUMENTS

| | | |
|---|---|---|
| JP | 2003-94494 A | 4/2003 |
| JP | 2003094494 | 4/2003 |

(Continued)

OTHER PUBLICATIONS

PCT International Search Report for PCT/EP2021/058879.

(Continued)

*Primary Examiner* — Brian O Peters
(74) *Attorney, Agent, or Firm* — Kelly McGlashen; Maginot, Moore & Beck LLP

(57) ABSTRACT

A fan includes a hub configured to be driven by motor to rotate about a fan rotational axis, blades that protrude radially from the hub and a band that surrounds the rotational axis and connects the tips of the blades. The band includes structurally-reinforcing ribs that protrude from the hub-facing surface of the band. A rib is disposed between respective tips of each pair of adjacent blades. Each rib bridges a knit-line of the band, and has a circumferential dimension that is at least 40 percent of a distance between the respective tips of the adjacent blades.

12 Claims, 7 Drawing Sheets

(56) References Cited

FOREIGN PATENT DOCUMENTS

| | | | |
|---|---|---|---|
| KR | 2015-0100307 | A | 9/2015 |
| KR | 20150100307 | | 9/2015 |

OTHER PUBLICATIONS

International Search Report corresponding to PCT Application No. PCT/EP2021/058879, dated Jun. 17, 2021 (English language document) (4 pages).

* cited by examiner

BANDED COOLING FAN BAND HAVING KNIT-LINE STRENGTH IMPROVEMENT

This application is a 35 U.S.C. § 371 National Stage Application of PCT/EP2021/058879, filed on Apr. 6, 2021, which claims the benefit of priority to (i) Ser. No. U.S. 63/006,840, filed on Apr. 8, 2020 in the United States, and (ii) Ser. No. U.S. 63/147,500, filed on Feb. 9, 2021 in the United States, the disclosures of which are incorporated herein by reference in their entirety.

BACKGROUND

Automobiles typically require one or more air-moving fans to aid in heat-transfer through one or more heat-exchangers. For example, an axial flow fan may be used for automotive cooling that includes a hub coupled to a shaft of a motor, a plurality of blades that protrude from an outer circumference of the hub, and a band that connects tips of the blades so as to prevent the blades from being deformed.

Such fans are often manufactured in large volumes via a plastic injection molding process in which a mold of the fan 100 is injected with molten plastic in the vicinity of the hub-forming portion (FIG. 1). From the injection point(s) 101, the molten plastic (represented by arrows) flows within the mold cavity from the hub-forming portion, radially outward through the blade forming portions, and then circumferentially along the band-forming portion. When two flow-fronts meet within the band-forming portion, a knit-line 150 is formed in the resulting fan band 120. Knit-lines 150 are formed in the band 120 approximately mid-way between each pair of adjacent fan blades 140. Knit-lines 150 are typically weaker than other regions of the band 120 where there are no knit-lines 150, and thus may be a point of failure initialization within the fan 100.

SUMMARY

In some aspects, a banded fan includes structurally reinforced knit-lines that improve the strength of band knit regions, thereby increasing overall the structural robustness of the fan.

To increase the stiffness and strength of the fan band between fan blades, where the band knit-line occurs, reinforcing ribs are provided on the hub-facing surface of the fan band cylindrical portion. Each rib protrudes inward toward the hub and extends circumferentially across (or "bridges") the knit-line. Each rib has a complex shape that minimizes air flow losses and unwanted noise, and is dimensioned to lower stress in the band while ensuring that the knit-line is bridged.

In some aspects, a fan includes a hub configured to be driven by motor to rotate about a fan rotational axis, and a band that surrounds the rotational axis and is concentric with the hub. The band includes a cylindrical portion that extends in parallel to the fan rotational axis, a lip portion that extends in a direction perpendicular to the fan rotational axis, and an intermediate portion that connects one end of the cylindrical portion to one end of the lip portion. The fan includes blades that protrude radially from the hub. Each blade has a root that is connected to the hub and a tip that is connected to a hub-facing surface of the cylindrical portion. The fan also includes a structurally-reinforcing rib that protrudes from the hub-facing surface of the cylindrical portion. The rib is disposed between respective tips of an adjacent pair of the blades. A circumferential dimension of the rib is at least 40 percent of a distance along the hub-facing surface between the respective tips of the blades of the adjacent pair of the blades.

In some embodiments, the reinforcing rib includes a leading end, a trailing end that is opposed to the leading end and is circumferentially spaced apart from the leading end, and opposed side surfaces that extend between the leading end and the trailing end. The circumferential dimension of the rib corresponds to a distance between the leading end and the trailing end. The circumferential dimension of the rib is greater than a thickness dimension of the rib, where the thickness dimension of the rib corresponds to a distance between the opposed side surfaces. In addition, the leading end and the trailing end are rounded.

In some embodiments, the circumferential dimension of the rib is at least ten times the thickness dimension.

In some embodiments, a radial dimension of the rib is non-uniform along the circumferential dimension of the rib.

In some embodiments, a radial dimension of the rib at the leading end and the trailing end is less than a radial dimension of the rib at a location that is midway between the leading end and the trailing end.

In some embodiments, a radial dimension of the rib is at most twenty percent of a blade span, the blade span corresponding to a distance between the root and the tip of one of the blades.

In some embodiments, the rib comprises a plurality of ribs, each rib being disposed between a pair of adjacent blades such that a single rib is disposed between the blades of a given pair of adjacent blades, and the circumferential dimension of the rib is proportional to the spacing between the respective tips of the blades of the given pair of adjacent blades.

In some embodiments, number of ribs equals the number of blades.

In some embodiments, the rib is disposed mid-way between the tips of the blades of the adjacent pair of the blades.

In some embodiments, the rib is disposed closer to a tip of one of the blades of the adjacent pair of blades than to the other of the blades of the adjacent pair of blades.

In some embodiments, the rib extends onto the intermediate portion.

DETAILED DESCRIPTION

Figure 1:
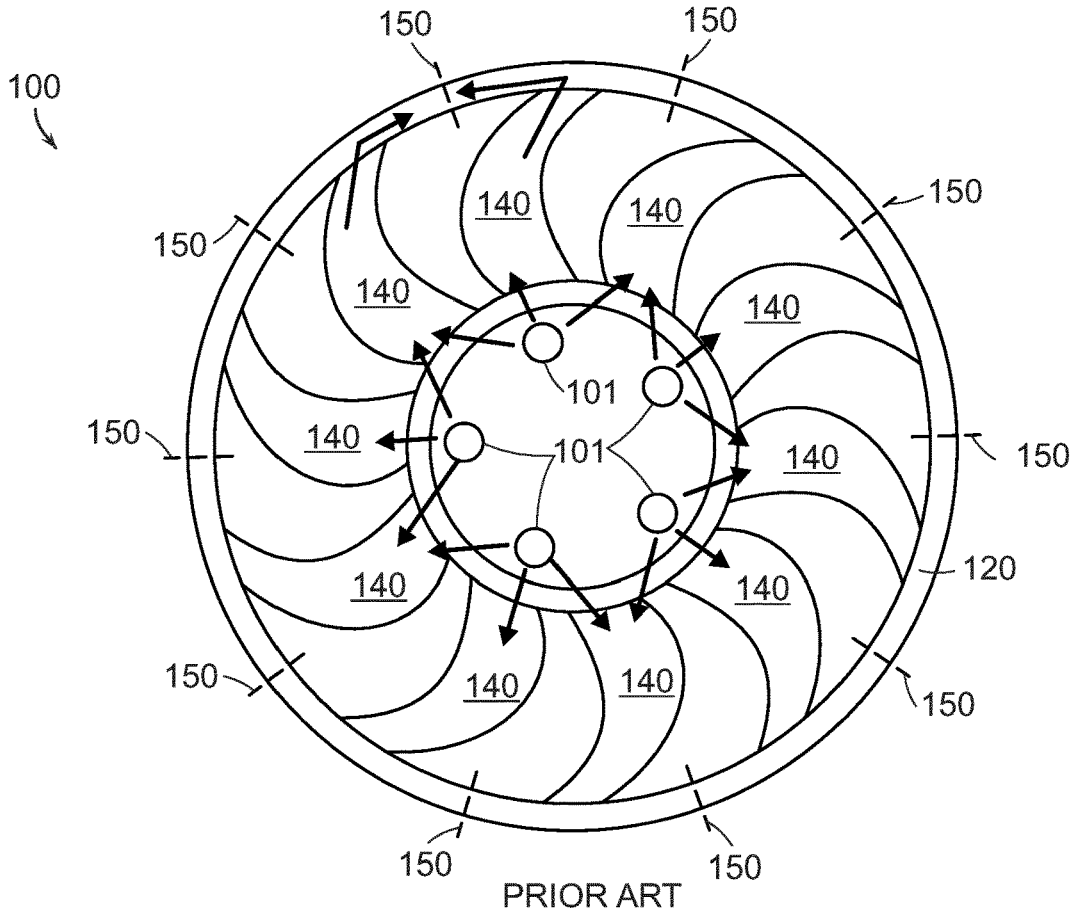
FIG. 1 is a schematic top plan view of a banded cooling fan marked with a) circles identifying locations of injection of molten plastic during an injection molding process of the fan; b) arrows showing a direction of flow of the molten plastic through a mold cavity during the injection molding process; and c) broken lines indicating locations of knit-lines between a pairs of adjacent fan blades.
Figure 2:
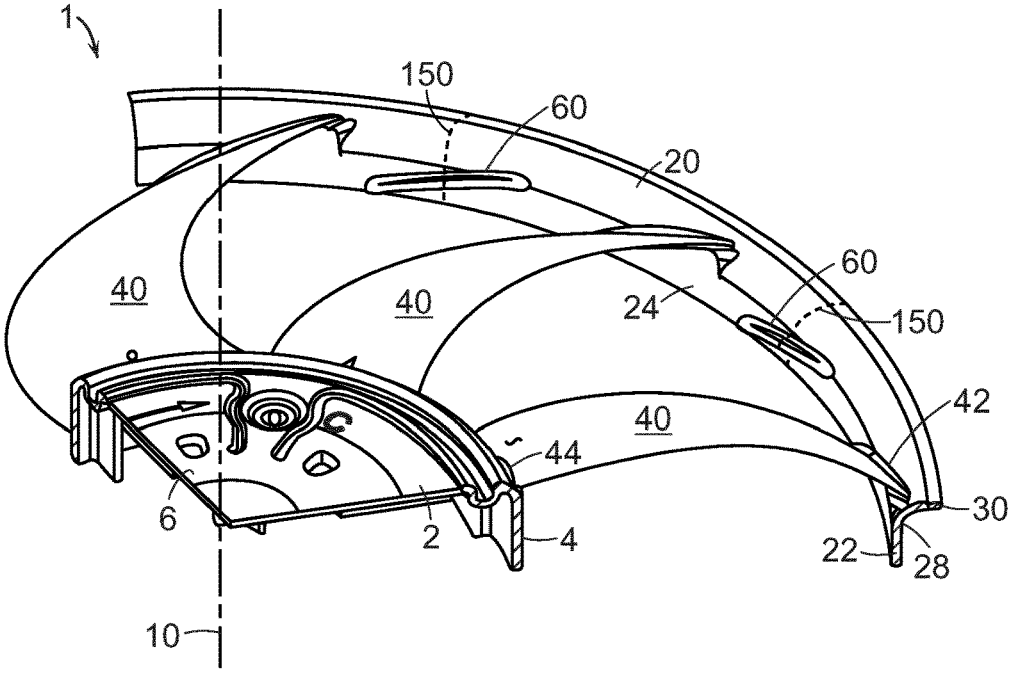
FIG. 2 is a perspective view of a portion of a banded cooling fan that includes a reinforcing rib, in which broken lines indicate locations of knit-lines between pairs of adjacent fan blades.
Figure 3:
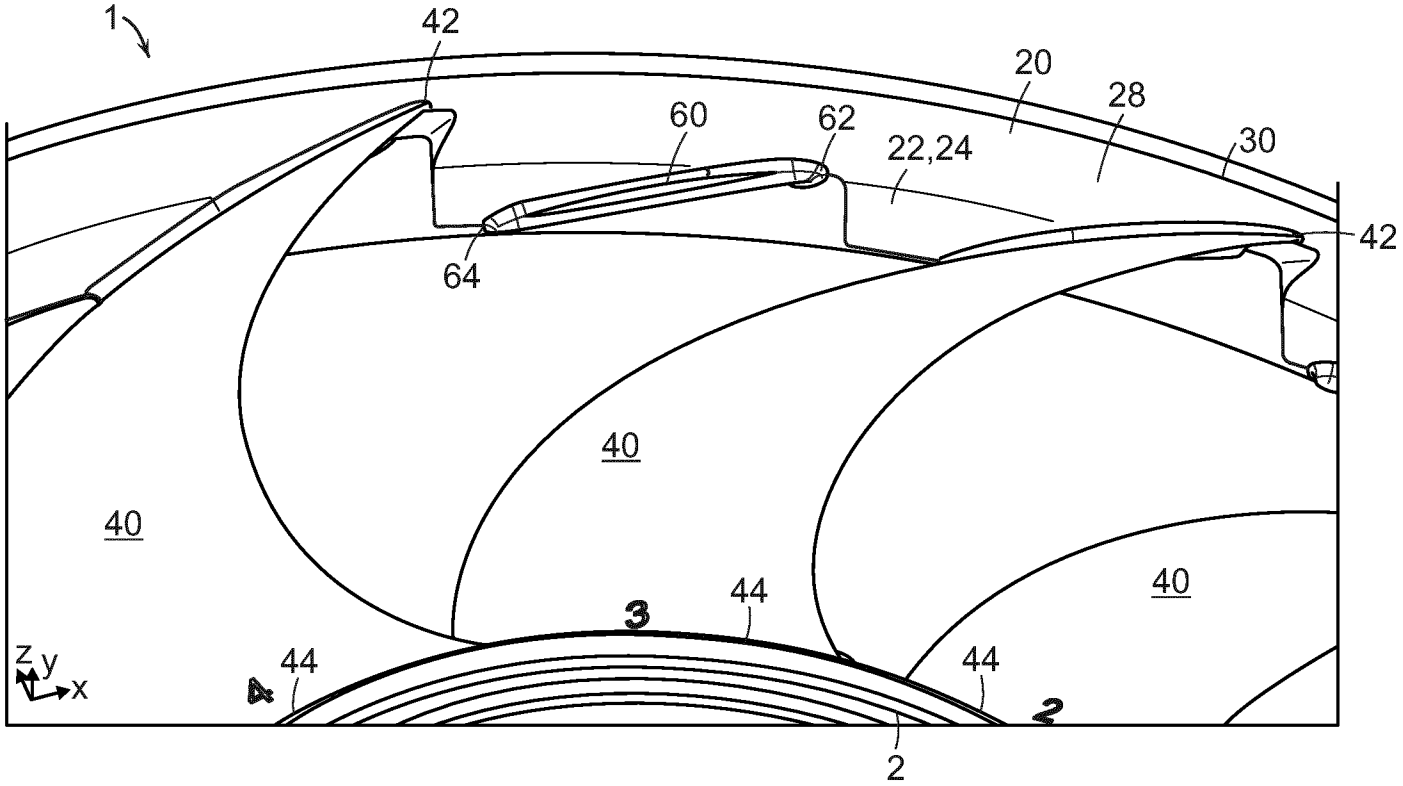
FIG. 3 is a perspective view of another portion of the banded cooling fan of FIG. 2.
Figure 4:
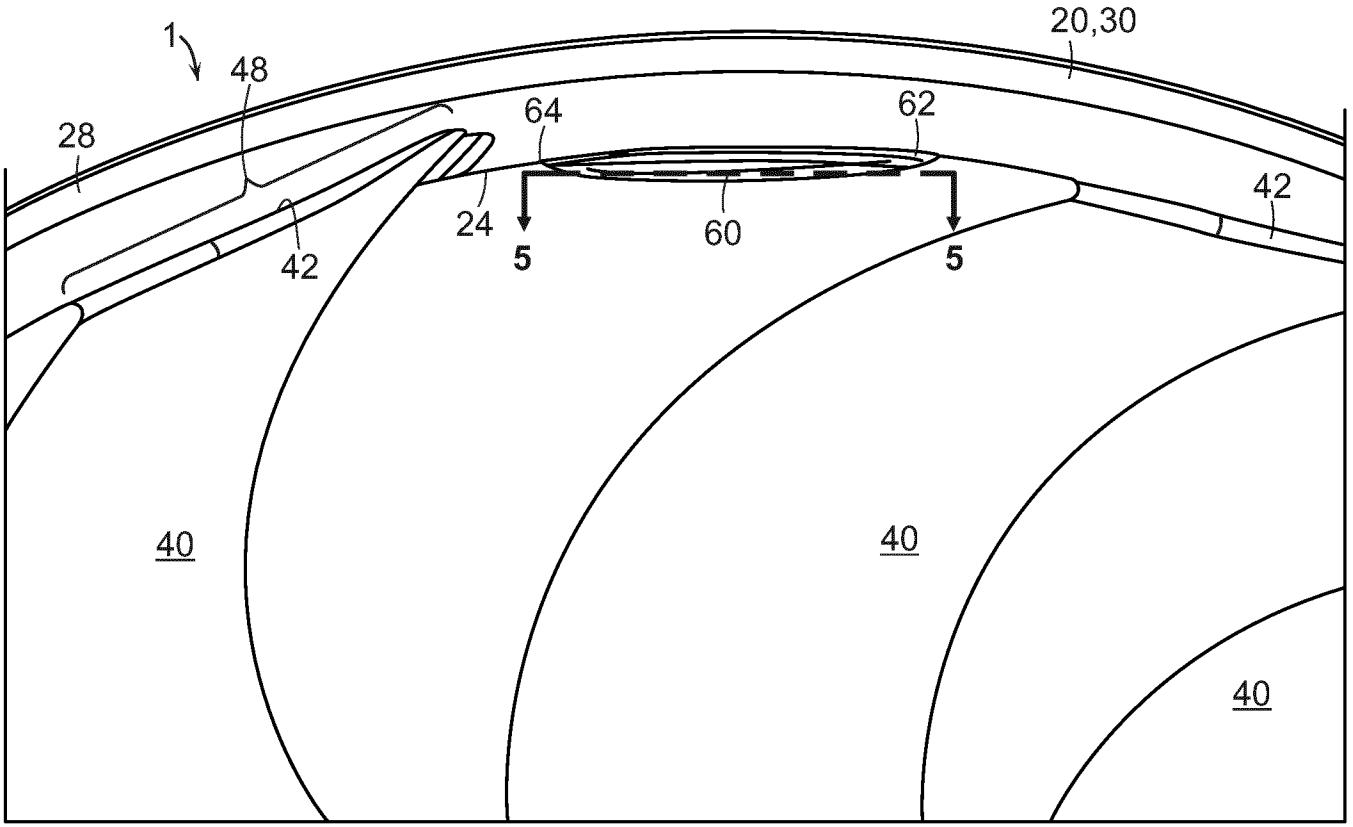
FIG. 4 is a top plan view of the portion of the banded cooling fan of FIG. 2.

Referring to FIGS. 2-8, an axial flow fan 1, which may be used for cooling heat exchange medium passing an inside of a heat exchanger such as a radiator of a automobile, is provided with a hub 2 that is coupled to a driving source (not shown) such as a motor. The fan 1 includes a plurality of blades 40 that protrude radially outward from the hub 2. In addition, the fan 1 includes a band 20 that surrounds the hub and connects the tips 42 of each blade 40 so as to prevent the blades 40 from being deformed. The hub 2, the blades 40 and the band 20 are formed as a single piece, for example in an injection molding process. The fan 1 is rotated by rotational force transferred from the motor to the hub 2. In the illustrated embodiment, the fan 1 rotates about the fan rotational axis 10 in the clockwise direction with respect to the view shown in FIG. 3. The band 20 includes reinforcing ribs 60 that reduce band stress and increase the structural integrity of the band 20 in the vicinity of the knit-lines 150. The ribs 60 are described in detail below.

The hub 2 is a hollow cylinder that is closed at one end by an end surface 6 that is perpendicular to the fan rotational axis 10. An outer circumference 4 of the hub 2 faces the band 20.

Each blade 40 includes a root 44 that is coupled to the band-facing surface 4 of the hub 2, and a tip 42 that is spaced apart from the root 44. Each tip 42 is coupled to a hub-facing surface 24 of the band 20. The air-flow directing surfaces of each blade 40 have a complex, three-dimensional curvature that is determined by the requirements of the specific application. The direction of the air flow that is discharged from the fan 1 is dependent at least in part on the blade curvature, and includes a substantial axial flow component. As used herein, the term "axial flow component" refers to a component of air flow that flows in a direction parallel to the fan rotational axis 10. The blade configuration, including the number of blades 40 employed by the fan 1, the shape of the blades 40, the blade spacing, etc., is determined by the requirements of the specific application.

The band 20 is generally an L-shaped circumferential ring that is concentric with hub 2 and is spaced radially outward from hub 2. In particular, the band 20 includes a cylindrical portion 22 that corresponds to one leg of the L-shape and extends in parallel to the fan rotational axis 10. The band 20 includes a lip portion 30 that corresponds to the other leg of the L-shape and extends in a direction perpendicular to the fan rotational axis 10. In addition the band 20 includes a curved intermediate portion 28 that connects one end of the cylindrical portion 22 to one end of the lip portion 30. The cylindrical portion 22 encircles the hub 2, and the lip portion 30 protrudes from the cylindrical portion 22 in a direction away from the hub 2. Each blade tip 42 is joined to the hub-facing surface 24 of the cylindrical portion 22 along a circumferentially-extending region referred to as the "blade-tip region" 48 of the cylindrical portion 22.

The band 20 includes structurally-reinforcing ribs 60 that protrude from the hub-facing surface 24 of the cylindrical portion 22. Each rib 60 includes a leading end 62, and a trailing end 64 that is opposed to the leading end 62 and is spaced apart from the leading end 52 along a circumference of the band 20. Each rib 60 includes opposed side surfaces 66, 68 that extend between the leading end 62 and the trailing end 64, and are spaced apart from each other in a direction parallel to the fan rotational axis 10. In the illustrated embodiment, the opposed side surfaces 66, 68 are generally linear and parallel to each other.

In some embodiments, the cross-sectional shape of the ribs 60 is "blade-like". As used herein, the term "blade-like" refers to having an aerodynamic shape, that is, a shape that reduces the drag from air moving past the rib 60. For example, the ribs 60 are generally aligned with the direction of air flow along the hub-facing surface 24 of the band 20, and include rounded leading and trailing ends 62, 64. By configuring the ribs 60 to have the shape of a blade, undesirable noise and undesirable aerodynamic losses are minimized.

Figure 5:
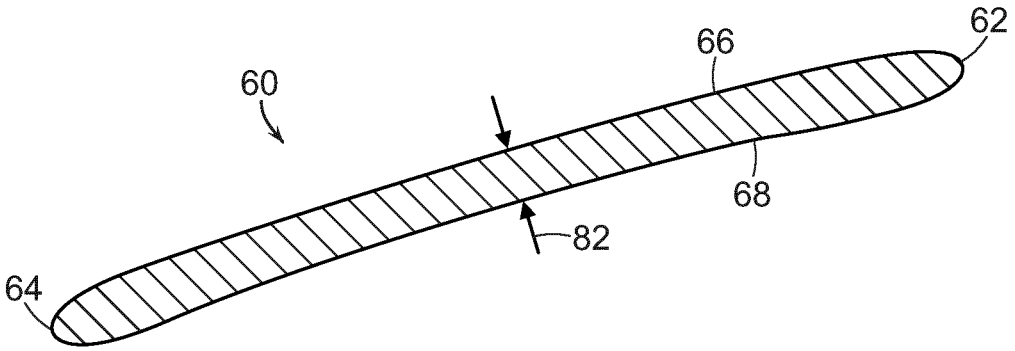
FIG. 5 is a cross-sectional view of the rib of FIG. 2 as seen along line 5-5 of FIG. 4.
Figure 6:
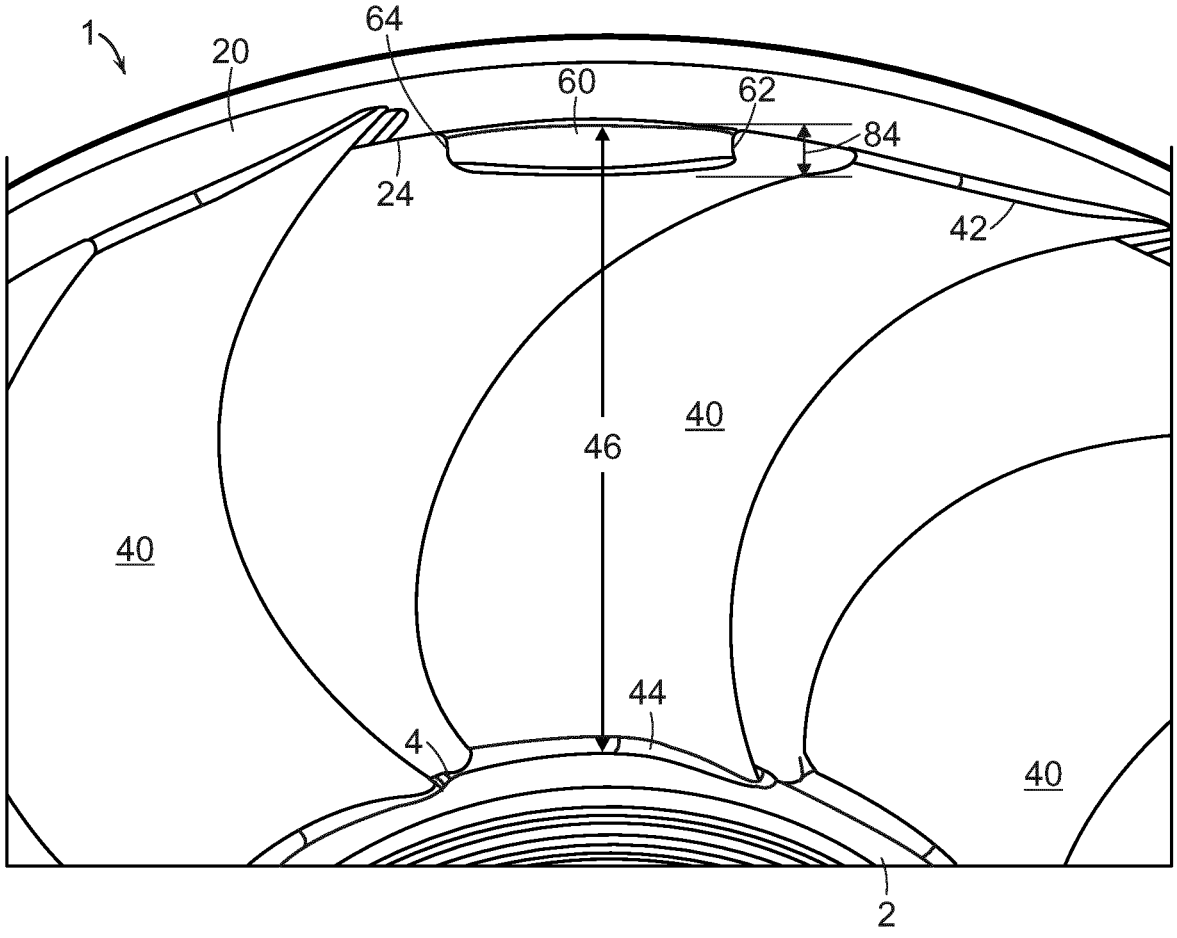
FIG. 6 is a top plan view of the portion of the banded cooling fan of FIG. 2 including markings showing the radial dimension of the rib and a blade radial span, and illustrating the rib with a slightly exaggerated radial dimension to allow visualization of the radial dimension of the rib.
Figure 7:
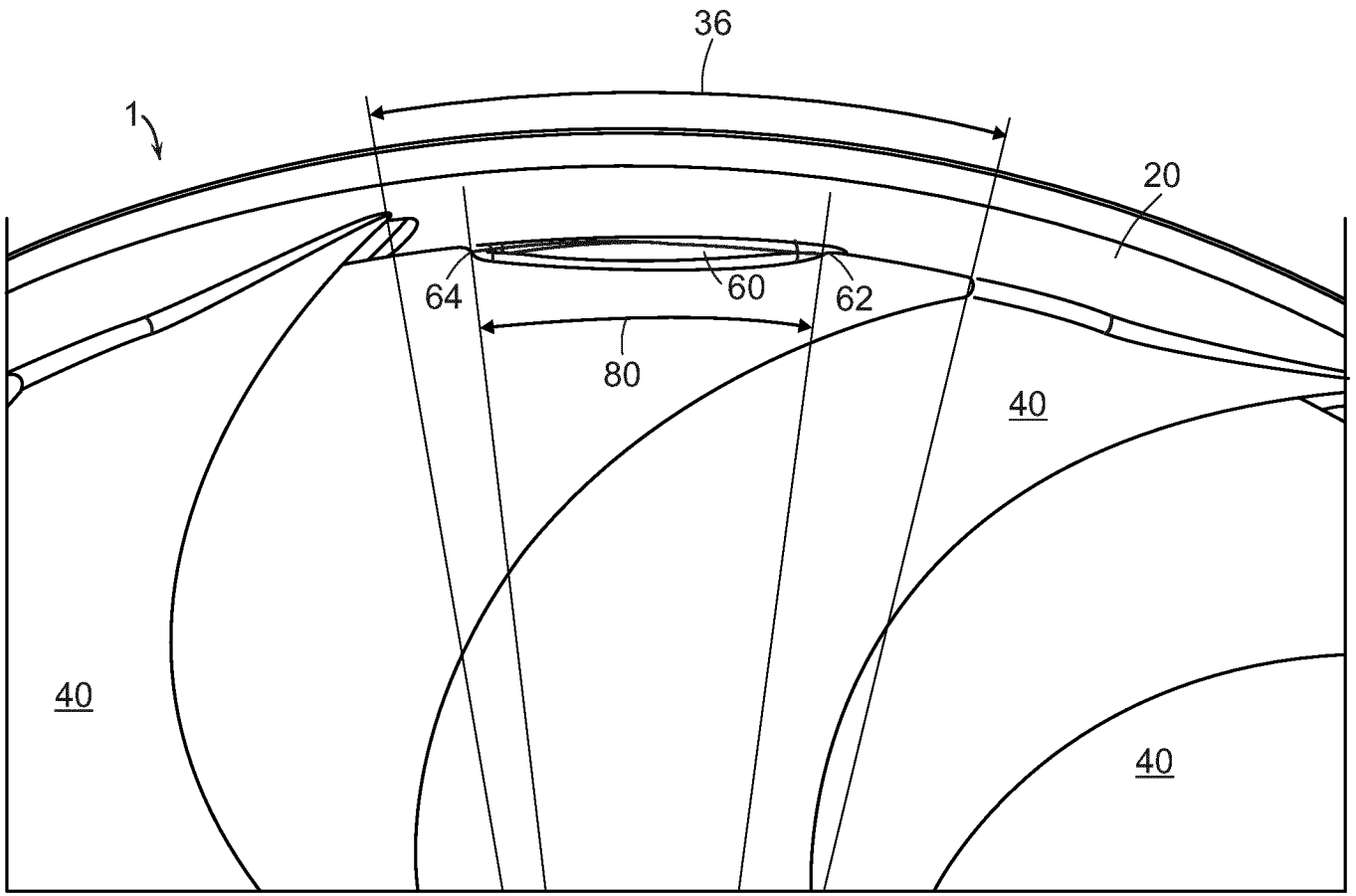
FIG. 7 is a top plan view of the portion of the banded cooling fan of FIG. 2 including markings showing the circumferential dimension of the rib and the inter-blade arc length.

Each rib 60 is elongated in that the circumferential dimension 80 of the rib 60 (e.g., a distance between the leading end 62 and the trailing end 64 along a circumference of the hub-facing surface 24, FIG. 7) is greater than a thickness dimension 82 of the rib 60 (e.g., a distance between the opposed side surfaces 66, 68, FIG. 5). The circumferential dimension 80 of the rib 60 is at least ten times the thickness dimension 82. For example, in the illustrated embodiment, the circumferential dimension 80 of the rib 60 is about twenty times the thickness dimension.

The band 20 includes a rib 60 disposed between each pair of adjacent blades 40 such that a single rib 60 is disposed between the blades 40 of a given pair of adjacent blades 40. In addition, the circumferential dimension 80 of the rib 60 is proportional to the spacing between the respective tips 42 of the adjacent blades 40. In the illustrated embodiment, the number of ribs 60 equals the number of blades 40.

The ribs 60 are disposed between respective tips 42 of an adjacent pair of the blades 40. In the illustrated embodiment the rib 60 is disposed mid-way between the respective tips 42 of the adjacent pair of blades 40 so as to extend across the corresponding knit-line 150. However, in applications in which the knit-line 150 is not disposed mid-way between the respective tips 42, such as might occur in fans having unequal blade spacing, it is understood that the rib 60 may be offset toward one blade of the adjacent pair of blades in order to bridge the knit-line 150.

In some embodiments, a circumferential dimension 80 of each rib 60 is at least 40 percent of the inter-blade arc length 36 (e.g., a distance along the hub-facing surface 24 between the respective tips 42, or blade tip regions 48, of adjacent blades 40, FIG. 7). Having such a large circumferential extent ensures that the band knit-line 150 will lie in the radial projection of the reinforcing rib 60. This ensures that the ribs 60 properly reinforce the respective knit-lines 150 even when there are relatively large variations in the location of plastic injection during the manufacturing process. In some embodiments, the ribs 60 extend circumferentially to an extent that the ribs 60 extend beyond the hub-facing surface 24 onto the curved intermediate portion 28 of the band 20.

To further reduce drag, each rib 60 has a non-uniform radial dimension 84 along the circumferential dimension of the rib 60, where the term "radial" is used with reference to the fan rotational axis 10. For example, the leading end 62 and the trailing end 64 of each rib 60 may have a smaller radial dimension 84 than a midportion of each rib 60. The ribs 60 have a low profile, in that the radial dimension 84 of the rib 60 is at most twenty percent of a blade span 46, where the blade span 46 corresponding to the distance between the root 44 and the tip 42 of one of the blades 40. This configuration reduces unwanted noise and aerodynamic issues such as air flow losses.

Figure 8:
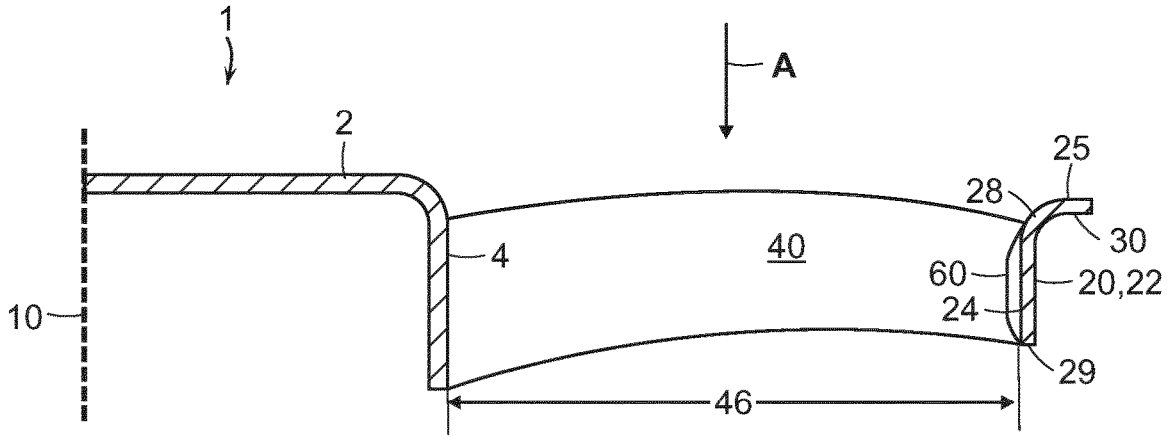
FIG. 8 is a side cross-sectional view of a portion of the fan of FIG. 2.
Figure 9:
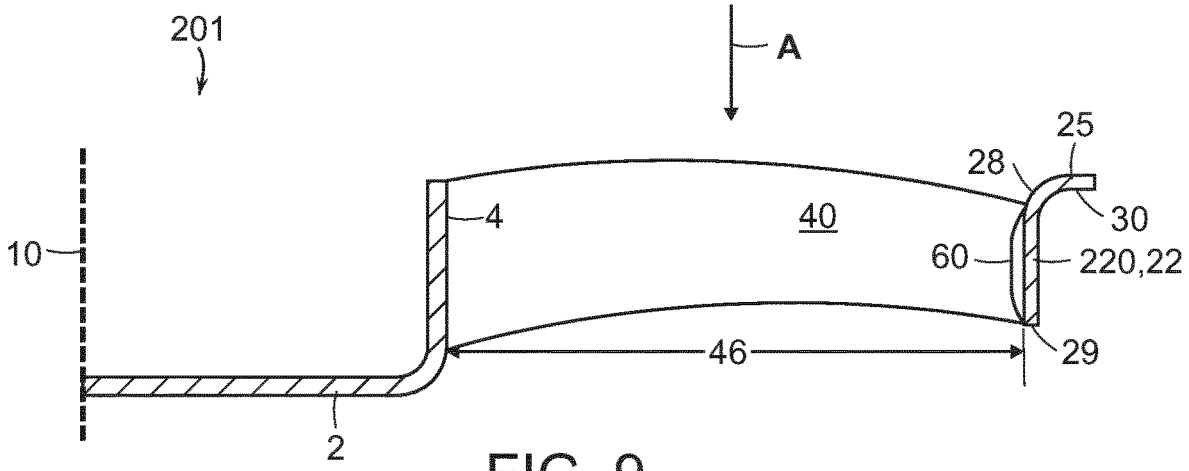
FIG. 9 is a side cross-sectional view of a portion of an alternative embodiment fan.
Figure 10:
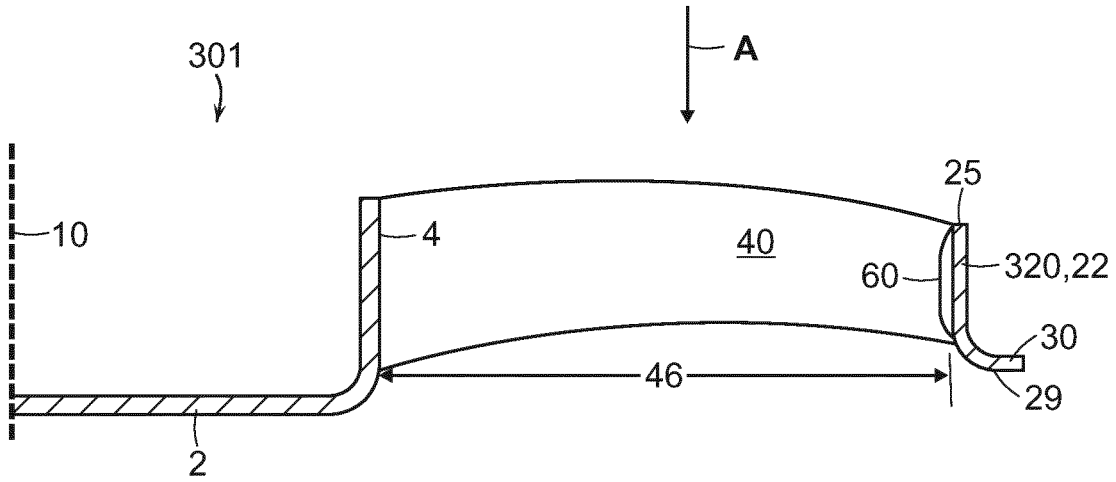
FIG. 10 is a side cross-sectional view of a portion of another alternative embodiment fan.
Figure 11:
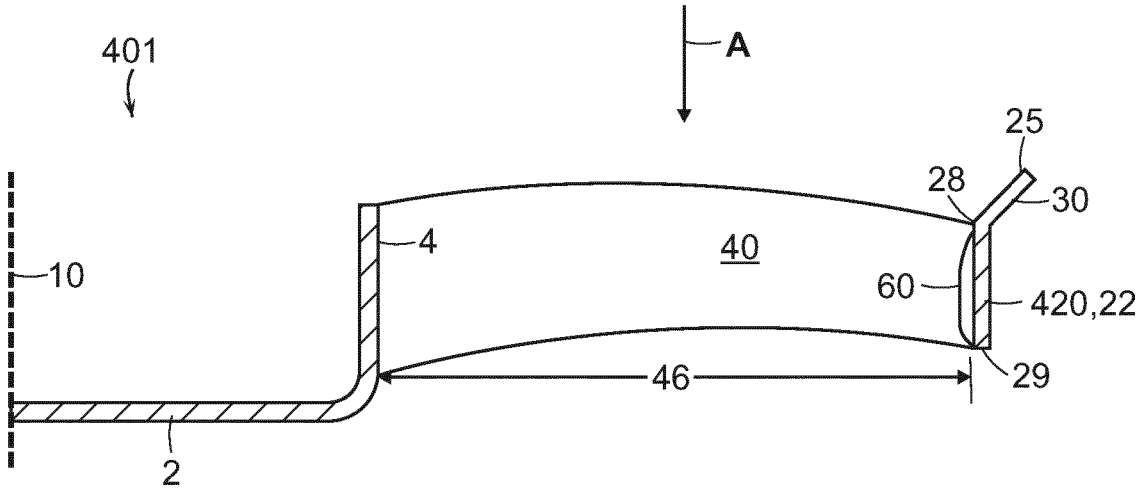
FIG. 11 is a side cross-sectional view of a portion of yet another alternative embodiment fan.

Employment of reinforcing ribs 60 on the band 20 is not limited to the fan 1 having a downstream-stator design, as shown in FIGS. 2-8, where the stator (not shown) supports a motor (not shown) which drives the fan 1 via the hub 2. In the downstream-stator design, the stator is disposed downstream of the fan 1 with respect to the direction A of air flow through the fan 1. In the downstream-stator design, the lip portion 30 provides a leading end 25 of the band 20. The reinforcing ribs 60 can be employed to reinforce the band knit lines 150 in a fan 201 having an upstream-stator design, as shown in FIG. 9. In an upstream-design, the stator is disposed upstream of the fan 201 with respect to the direction A of air flow through the fan 201. In FIG. 9, the lip portion 30 provides the leading end 25 of the band 220. In an alternative fan 301 having an upstream-stator design (FIG. 10), the lip portion 30 provides the trailing end 29 of the band 320. Although the lip portion 30, as shown in FIGS. 8-10, may extend in a direction perpendicular to the fan rotational axis 10, the lip portion 10 is not limited to this configuration. For example, in some embodiments, the lip portion 30 may extend at an acute angle relative to the fan rotational axis 10, as shown in the alternative band 420 of the upstream-stator design fan 401 illustrated in FIG. 11, or in downstream-stator design fans (not shown).

Although the cooling fans illustrated in FIGS. 2-11 are automotive cooling fans, the cooling fans described in FIGS. 2-11 are not limited to automotive applications. For example, the cooling fans may be used in a computer to cool a hard drive, in a heating and ventilation unit to cool a compressor, etc. Moreover, the cooling fans illustrated in FIGS. 2-11 are not limited to cooling applications.

Selective illustrative embodiments of the fan are described above in some detail. It should be understood that only structures considered necessary for clarifying the fan have been described herein. Other conventional structures, and those of ancillary and auxiliary components of the fan, are assumed to be known and understood by those skilled in the art. Moreover, while a working example of the fan has been described above, the fan is not limited to the working example described above, but various design alterations may be carried out without departing from the fan as set forth in the claims.

We claim:

1. A fan, the fan comprising:

a hub configured to be driven by motor to rotate about a fan rotational axis;

a band that surrounds the rotational axis and is concentric with the hub, the band including a cylindrical portion that extends in parallel to the fan rotational axis, a lip portion that extends in at an angle to the fan rotational axis, and an intermediate portion that connects one end of the cylindrical portion to one end of the lip portion;

blades that protrude radially from the hub, each blade comprising a root that is connected to the hub and a tip that is connected to a hub-facing surface of the cylindrical portion; and a structurally-reinforcing rib that protrudes from the hub-facing surface of the cylindrical portion, the rib disposed between respective tips of an adjacent pair of the blades, wherein a circumferential dimension of the rib is at least 40 percent of a distance along the hub-facing surface between the respective tips of the blades of the adjacent pair of the blades, wherein the rib extends onto the intermediate portion.

2. The fan of claim 1, wherein the reinforcing rib includes a rib leading end, a rib trailing end that is opposed to the rib leading end and is circumferentially spaced apart from the rib leading end, and opposed side surfaces that extend between the rib leading end and the rib trailing end, and wherein the circumferential dimension of the rib corresponds to a distance between the rib leading end and the rib trailing end, the circumferential dimension of the rib is greater than a thickness dimension of the rib, where the thickness dimension of the rib corresponds to a distance between the opposed side surfaces, and the rib leading end and the rib trailing end are rounded.

3. The fan of claim 2, wherein the circumferential dimension of the rib is at least ten times the thickness dimension.

4. The fan of claim 2, wherein a radial dimension of the rib is non-uniform along the circumferential dimension of the rib.

5. The fan of claim 2, wherein a radial dimension of the rib at the rib leading end and the rib trailing end is less than a radial dimension of the rib at a location that is midway between the rib leading end and the rib trailing end.

6. The fan of claim 2, wherein a radial dimension of the rib is at most twenty percent of a blade span, the blade span corresponding to a distance between the root and the tip of one of the blades.

7. The fan of claim 1, wherein the rib comprises a plurality of ribs, each rib being disposed between a pair of adjacent blades such that a single rib is disposed between the blades of a given pair of adjacent blades, and the circumferential dimension of the rib is proportional to the spacing between the respective tips of the blades of the given pair of adjacent blades.

8. The fan of claim 7, wherein the number of ribs equals the number of blades.

9. The fan of claim 1, wherein the rib is disposed mid-way between the tips of the blades of the adjacent pair of the blades.

10. The fan of claim 1, wherein the rib is disposed closer to a tip of one of the blades of the adjacent pair of blades than to the other of the blades of the adjacent pair of blades.

11. The fan of claim 1, wherein the lip portion faces a direction of air flow through the fan, and the cylindrical portion is downstream of the lip portion with respect to the direction of air flow through the fan.

12. The fan of claim 1, wherein the cylindrical portion faces a direction of air flow through the fan, and the lip portion is downstream of the cylindrical portion with respect to the direction of air flow through the fan.

* * * * *